US007226247B2

(12) United States Patent
Barrett et al.

(10) Patent No.: US 7,226,247 B2
(45) Date of Patent: Jun. 5, 2007

(54) METHOD AND APPARATUS FOR CREATING SOIL OR ROCK SUBSURFACE SUPPORT

(76) Inventors: Robert K. Barrett, 549 S. Broadway, Grand Junction, CO (US) 81503; Albert C. Ruckman, 11488 Nucla, Commerce City, CO (US) 80022

( * ) Notice: Subject to any disclaimer, the term of this patent is extended or adjusted under 35 U.S.C. 154(b) by 0 days.

(21) Appl. No.: 10/741,951

(22) Filed: Dec. 18, 2003

(65) Prior Publication Data

US 2005/0135882 A1 Jun. 23, 2005

(51) Int. Cl.
*E21D 20/00* (2006.01)

(52) U.S. Cl. ..... 405/259.5; 173/90; 405/232

(58) Field of Classification Search ..... 405/229, 405/232, 236, 239, 244, 253, 259.5; 173/90
See application file for complete search history.

(56) References Cited

U.S. PATENT DOCUMENTS

| | | | | | |
|---|---|---|---|---|---|
| 571,225 | A | | 11/1896 | Geisel | 52/87 |
| 1,597,573 | A | * | 8/1926 | Blue | 40/124.5 |
| 3,060,694 | A | | 10/1962 | Holmes | 61/53.62 |
| 3,286,416 | A | * | 11/1966 | Ashworth | 52/153 |
| 3,487,646 | A | | 1/1970 | Gatlen | 61/53 |
| 3,496,729 | A | | 2/1970 | Pleuger | 61/53.6 |
| 3,808,624 | A | | 5/1974 | Barkdull, Jr. | 14/77.1 |
| 3,981,038 | A | | 9/1976 | Vidal | 14/26 |
| 4,181,995 | A | | 1/1980 | Zur | 14/77.1 |
| 4,360,292 | A | * | 11/1982 | Keeler et al. | 405/244 |
| 4,564,313 | A | | 1/1986 | Niswander et al. | 405/125 |
| 4,564,967 | A | | 1/1986 | Vidal | 14/75 |
| 4,571,124 | A | | 2/1986 | Matsui et al. | 405/239 |
| 4,993,872 | A | | 2/1991 | Lockwood | 405/125 |
| 5,044,831 | A | | 9/1991 | Myles et al. | 405/259 |
| 5,472,296 | A | * | 12/1995 | von Allmen et al. | 405/233 |
| 5,494,378 | A | * | 2/1996 | Hanson | 405/244 |
| 5,542,785 | A | | 8/1996 | Cloud | 405/239 |
| 5,549,418 | A | | 8/1996 | Devine et al. | 405/258.1 |
| 5,669,199 | A | * | 9/1997 | Ludwig et al. | 52/704 |
| 5,713,162 | A | | 2/1998 | Gallo et al. | 52/167.1 |

(Continued)

FOREIGN PATENT DOCUMENTS

EP 0 307 291 11/1980

OTHER PUBLICATIONS

Poly(Vinyl Chloride) 1995, 1996, http://www.psrc.usm.edu/macrog/pvc.htm.*

(Continued)

*Primary Examiner*—Tara L Mayo
(74) *Attorney, Agent, or Firm*—Sheridan Ross PC

(57) ABSTRACT

A subsurface support includes a protective outer member that encases an interior support member. The inner support member may typically be a steel or iron rod which is held within the outer tube as by grout or cement. The outer tube is preferably emplaced by forcing the outer tube into the ground by use of a launching device. The distal end of the outer tube is pointed thus allowing easier penetration of the outer tube into the ground. The subsurface support may be used in numerous functional ways to provide support for an overlying man made structure, or to stabilize surrounding rock and soil. The support can be used in compression, tension, bending, and/or shear.

2 Claims, 3 Drawing Sheets

U.S. PATENT DOCUMENTS

| | | | | |
|---|---|---|---|---|
| 5,713,701 | A | 2/1998 | Marshall | 405/232 |
| 6,280,120 | B1 | 8/2001 | Okamoto et al. | 405/232 |
| 6,533,498 | B1 | 3/2003 | Quin | 405/125 |
| 6,652,195 | B2 * | 11/2003 | Vickars et al. | 405/239 |
| 6,776,242 | B1 * | 8/2004 | Cunningham | 173/90 |
| 6,926,186 | B2 * | 8/2005 | Wells | 227/129 |
| 7,025,016 | B1 * | 4/2006 | Landes | 116/209 |
| 2004/0011847 | A1 * | 1/2004 | Wells | 227/130 |

OTHER PUBLICATIONS

Colorado DOT Demonstration "The Soil Nail Launcher, Where Speed, Cost and the Environment are Important" www.soilnail-launcher.com; 1 page.

Colorado Department of Transportation Bridge Design Manual Section Seven, Substructures (Sections 7.1-7.3); Nov. 2, 1987.

* cited by examiner

METHOD AND APPARATUS FOR CREATING SOIL OR ROCK SUBSURFACE SUPPORT

TECHNICAL FIELD

The present invention relates generally to subsurface supports placed in the ground, and more particularly, to a method and apparatus for creating a soil or rock subsurface support that can be used in multiple ways to include support for excavations as a passive soil nail in tension, bending and/or shear, support to stabilize sloping terrain as a tieback in tension, support for an above ground structure as a micropile in compression and/or shear, or support for an above ground structure as an anchor in tension.

BACKGROUND OF THE INVENTION

In the construction of buildings, bridges, and other man-made structures, it is well known to place passive supports such as footers, piles, and other subsurface supports for supporting such man-made structures. These types of supports are passive because the earth around the subsurface support must first shift or move to mobilize the available tensile, bending, or shear capacities.

One particular problem associated with subsurface supports which may be made of iron, steel, or other metals is that over time, corrosion takes place which ultimately degrades the ability of the support to provide designed support for an overlying structure.

In addition to providing the above mentioned subsurface supports, it is also known to provide ground strengthening by driving elongate reinforcing members, referred to as soil nails, into the ground in an array thus improving the bulk properties of the ground. The soil nails themselves are not used for direct support of an overlying structure; rather, the soil nails are simply used to prevent shifting or other undesirable properties or characteristics of a particular geological formation which is built upon.

In some cases, the earth surrounding or near a man made structure becomes unstable and requires active support, such as by a tieback. Tiebacks are pre-tensioned subsurface supports that are used to restrain any movement of surrounding soil and rock. Tiebacks are similar to passive soil nails in construction, and can be emplaced in a similar fashion as a soil nail. More recently, soil nails and tiebacks have also been used to provide temporary and permanent excavation support and slope stabilization.

The U.S. Pat. No. 5,044,831 discloses a method of soil nailing wherein a soil nail is placed in the ground by being fired from a barrel of a launcher. The soil nail is loaded into the barrel, and pressurized gas emitted from the barrel forces the soil nail into the ground to a desired depth. One advantage of using a soil nail launcher, is that the soil nails can be emplaced with a minimum amount of labor and equipment thereby minimizing environmental impacts as well as providing a simple and economical means of strengthening the ground. Drilling is the traditional way to install soil nails, tiebacks, and anchors.

Although there are a multitude of subsurface supports and methods by which subsurface supports can be emplaced, there is still a need for simple and effective subsurface supports and an environmentally friendly manner in which subsurface supports are emplaced.

SUMMARY OF THE INVENTION

In accordance with the present invention, a method and apparatus are provided to create a subsurface support device that is placed in the ground. The support device of the present invention has many potential uses. In one use, the support device of the present invention can be used as a passive soil nail. In another use, the support device of the present invention can be used as an active tieback in tension. More generally, for use as a tieback, the support device of the present invention can also be referred to as a soil or rock inclusion. The term inclusion refers to the ability of the support device to increase the tensile capacity of the rock and soil. In yet another use, the support device of the present invention can be used as a micropile in compression, bending and shear. The support device when acting as a micropile can be physically connected to an overlying structure. In yet another use, the support device of the present invention can be used as an anchor in tension. For example, the support may be tensioned as by a cable that interconnects the support to a man made structure.

Once emplaced, the support device of the present invention includes a protective outer member or tube, an inner support member, and a stabilizing mixture, preferably in the form of grout, cement, resin, or combinations thereof which fixes the inner support member within the outer protective member. The stabilizing mixture may also be referred to as a cementious mixture. The outer protective member supports the opening into the native rock and soil, and acts as a housing for the cementious mixture. As discussed further below, the outer member may be perforated thereby allowing the cementious material to exit the perforations and increase the overall tensile and compressive contribution of the support device. The outer protective member also provides a barrier to prevent water or other corrosive materials from contacting the inner support member. The inner support member provides the design tensile and compressive strength of the support. The inner support member may protrude a desired distance above the outer member to connect to an overlying structure to provide support in any desired manner to include bearing/compression, tension, and/or shear. The diameter and length of the outer member and inner member can be selected to provide the necessary support. The outer member and stabilizing mixture provide strengthening support to the inner member. For example, in compression, the forces are transmitted from the inner support member directly to the stabilizing mixture and the outer member. In tension, forces are also transmitted to the stabilizing mixture and the outer member thereby greatly increasing the force necessary to dislodge or pull out the inner member. The method by which the outer member of the subsurface support is emplaced in the ground is preferably by a launching mechanism, such as that disclosed in the U.S. Pat. No. 5,044,831.

Other features and advantages of the present invention will become apparent by a review of the following figures, taken in conjunction with the detailed description.

DETAILED DESCRIPTION

Figure 1:
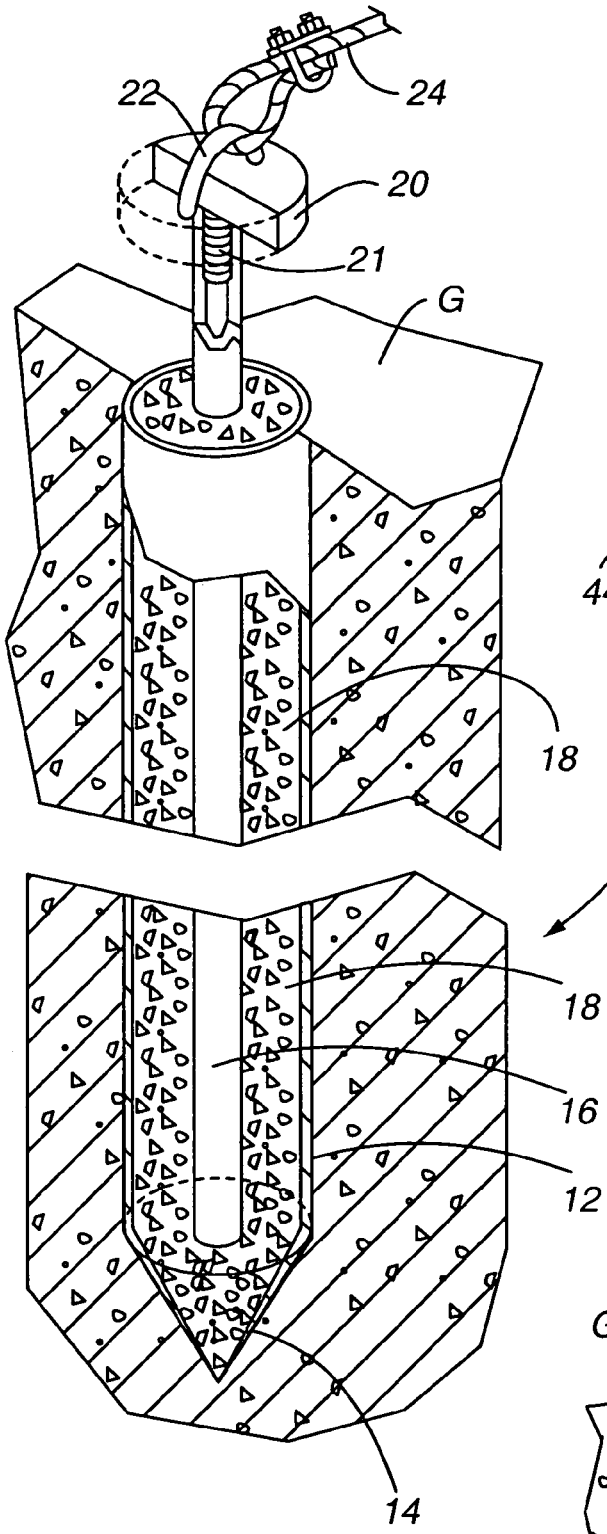
FIG. 1 is a cross-section of the subsurface support of the present invention in a first embodiment, the support device being emplaced in the ground and providing tensioning support to an overlying above ground structure.

Referring to FIG. 1, the subsurface support 10 in a first embodiment of the present invention is shown installed in the ground G. The support device includes an outer member, preferably in the form of a steel or iron tube 12 of a selected length and diameter, and having an integral pointed tip 14. The tip 14 can be conical in shape which facilitates emplacement of the outer tube as by a launcher, as discussed below. After the outer tube is emplaced, the stabilizing mixture is placed in the interior chamber of the outer tube. Then, an inner support member which can be in the form of an epoxy coated steel rod or bar is then placed within the stabilizing mixture prior to hardening of the mixture. When the stabilizing mixture cures, the inner support member 16 can provide support to an overlying structure in compression, tension, and/or shear. Depending upon the design requirements of the particular structure to be built, a plurality of subsurface supports may be emplaced at desired locations at the construction site, and each of the support devices can be sized to provide the necessary support.

FIG. 1 also illustrates one example of the manner in which the support device 10 provides support. This one example illustrates use of the subsurface support as an anchor in tension. The subsurface support 10 includes a head or cap 20 which is connected to the exposed upper end of the inner support member 16. This head or cap can be attached by an integral threaded member 21 which is placed into a threaded well formed in the upper end of the inner support member 16. The cap or head 20 then can be used for attachment to the overlying structure. In the example of FIG. 1, a ring 22 attaches to the cap 20, and a cable 24 connects to the above ground structure (not shown). Thus, in FIG. 1, the support device is used for providing tensioning support to the manmade structure. If the device 10 was needed to provide support in compression, the inner support member 16 could be directly connected to the foundation or other base support of the overlying manmade structure, as further discussed below with respect to FIG. 3.

Figure 2:
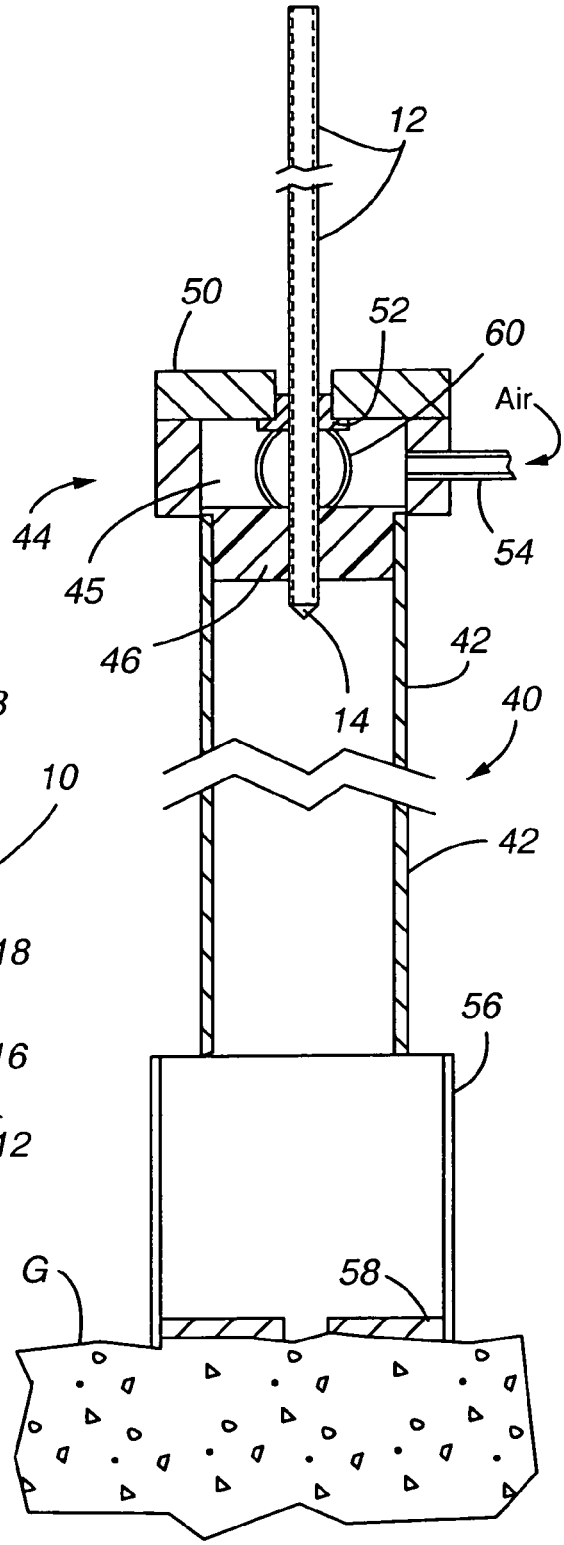
FIG. 2 is a cross-section illustrating an example launcher which may be used to emplace the outer member of the support device.

Referring now to FIG. 2, a launching device 40 is shown as a preferred method in which to emplace the outer member of the device 10. The launcher 40 illustrated in FIG. 2 corresponds to the launcher illustrated in the U.S. Pat. No. 5,044,831, this reference being incorporated herein in its entirety. The launcher 40 is shown in its loaded condition with an outer member/tube 12 loaded in the launcher and ready for firing. The outer tube 12 with the pointed end 14 is capable of penetrating the ground upon sufficient impact force. The launcher 40 comprises a barrel 42 communicating with a breach 44. The breach 44 defines an upper chamber 45. The distal or forward end of the outer tube 12 is received within an annular shaped sabo, preferably made of a plastics material, which is slidably received within the barrel 42 adjacent the chamber 45. The trailing or proximal end of the outer tube 12 extends through the chamber 44 and projects rearwardly of the launcher 40 through an aperture formed in the cap or upper surface 50 of the breach 44. An annual shaped breach seal 52 seals the outer tube 12 with respect to the upper surface 50. A gas inlet tube 54 communicates with the chamber 45 for the admission of compressed gas. A baffle 56 of a larger diameter than the barrel 40 forms an axial projection of the barrel extending into contact with the surface of the ground G. On firing the launcher, compressed gas is forced into the chamber 45 which causes outer tube 12 to be fired into the ground. The baffle 56 includes a locating ring 58 which forms a snug fit around the sabo 46 such that the launcher remains in alignment with the outer tube which is emplaced in the ground. Accordingly, the outer tube when emplaced, remains in coaxial alignment with the barrel 42. As also shown in FIG. 2, the breach seal 52 and sabo 46 may be held in position prior to firing by a plurality of resilient members 60 which exert a separating force between the seal and the sabo.

Although a launcher of a particular construction is illustrated in FIG. 2, it shall be understood that other launcher types and methods can be used to emplace the outer tube within the ground. For example, a launcher which makes use of an explosive charge may be used. Alternatively, a vibratory means may also be used along with some force which helps to ease the outer tube into the ground. As stated above, it is preferable to avoid excavation for emplacement of the outer tube as such excavation is equipment and manpower intensive, and environmentally unfriendly.

Figure 3:
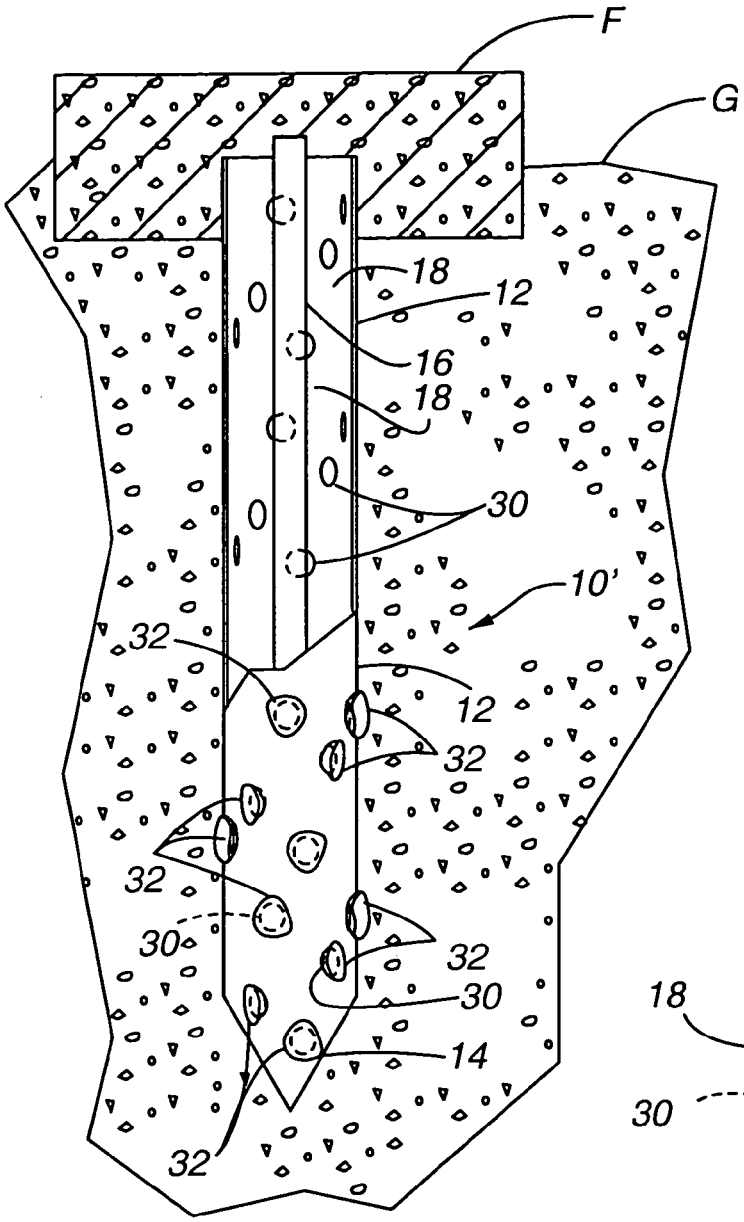
FIG. 3 is a partial cross-section illustrating a second embodiment of the support device emplaced in the ground and providing compression or bearing support to an overlying structure.

FIG. 3 illustrates a second embodiment 10' of the present invention. The support device 10' is the same as shown with respect to the subsurface support of the first embodiment, with the exception of a plurality of perforations/openings 30 which may be formed in the outer tube 12. FIG. 3 also illustrates the device 10' used to support an overlying structure S in compression. More specifically, the device 10' has its upper end 28 embedded within a concrete foundation F of a structure S. The foundation is shown as extending a distance below ground level G. As also shown in FIG. 3, the plurality of perforations/openings 30 which may be formed in the outer tube allow the stabilizing material 18 to flow out from the openings 30, thus forming external stabilizing structures 32. In compression or tension, these external stabilizing features 32 help to strengthen the connection of the device 10' to the surrounding soil. When filling the interior chamber of the outer tube with the stabilizing mixture 18, such filling may take place under pressure so that a desired quantity of the stabilizing mixture 18 exits the perforation/openings 30, thereby forming the external stabilizing features 32. In order to completely fill the interior chamber of the outer tube, it may be preferable to commence filling of the chamber from the lower most portion of the chamber. A line (not shown) carrying the stabilizing mixture under pressure can be inserted in the chamber and extend to the lower most end of the support device, and then as the stabilizing mixture fills the chamber, the line may be raised as necessary. Those skilled in the art can envision other ways in which the stabilizing mixture can fill the chamber of the outer tube.

Figure 3A:
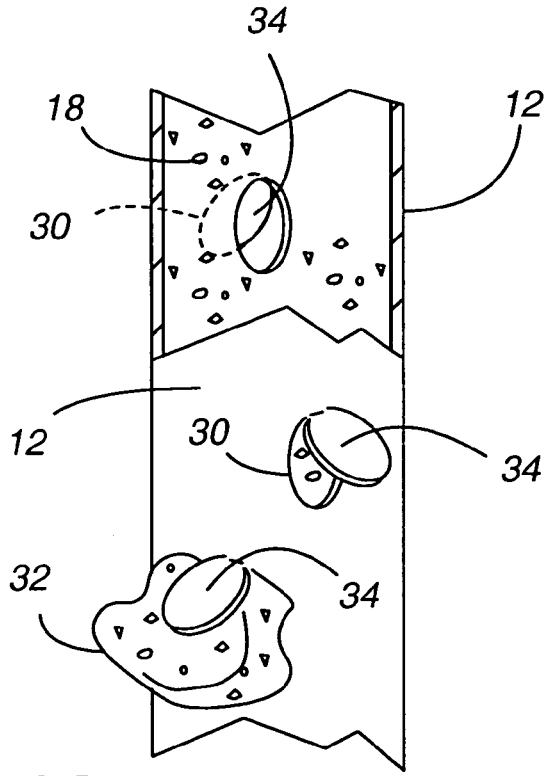
FIG. 3A is an enlarged section of FIG. 3 illustrating one way in which to provide holes or perforations in the subsurface support.

Now referring to FIG. 3A, an enlarged section of the support device 10' is shown specifically illustrating one manner in which holes or perforations may be made in the outer tube 12. In FIG. 3A, the openings 30 are formed by creating moon shaped cutouts thereby leaving a chad or tab 34. The chad or tab 34 would be pushed away from the exterior surface of the outer tube 12 as the pressurized stabilizing mixture exited the interior chamber of the outer tube. Alternatively, holes could be drilled or punched in the outer tube 12 in order to create an opening by which the stabilizing mixture could flow through. Those skilled in the art can envision other ways in which openings may be formed through the outer tube 12 in order to facilitate flow of stabilizing mixture therethrough to create the external stabilizing features 32.

Figure 4:
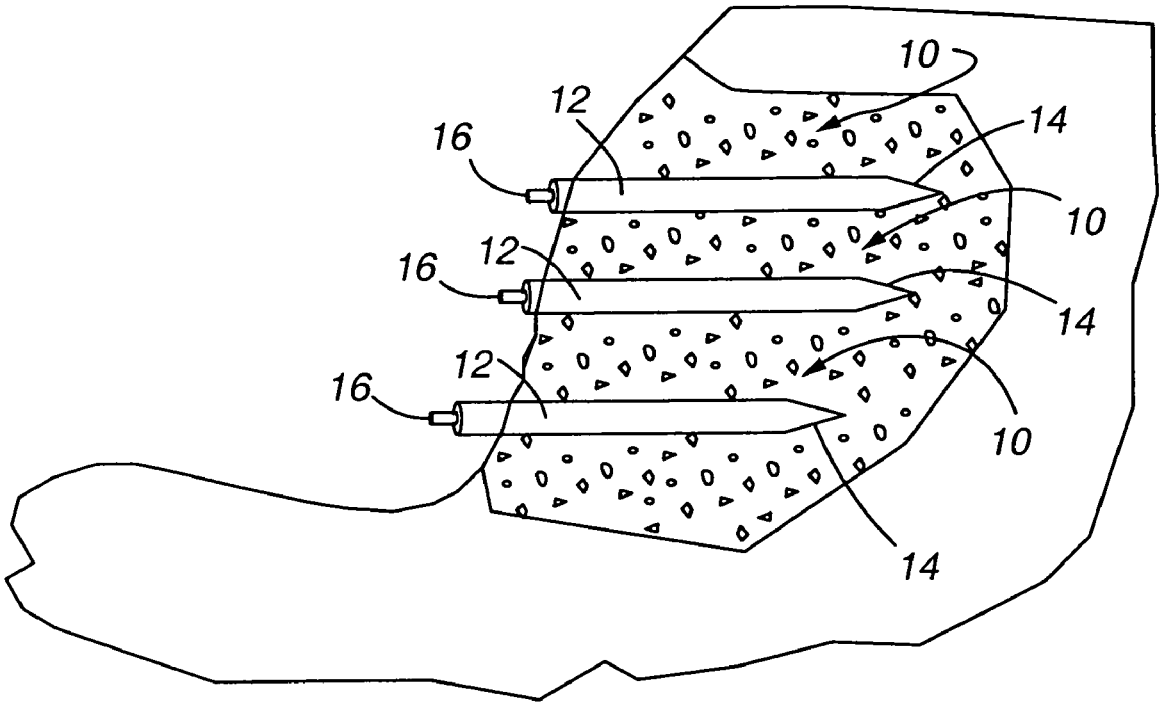
FIG. 4 is a simplified elevation of a plurality of support devices that may be used as passive soil nails or as tiebacks to stabilize a sloping surface, the supports being emplaced in a horizontal orientation.

FIG. 4 illustrates use of the subsurface support of the invention to stabilize a sloping surface. In the figure, three support devices 10 are illustrated and are spaced from one another in a desired arrangement to best support the sloping surface. The support devices are disposed in a horizontal orientation, but it shall be understood that the support devices may be placed at any angle or orientation depending upon the surrounding terrain. The support devices in FIG. 4 would be representative of use of the supports as either passive soil nails or tiebacks.

Additionally, the subsurface support of the present invention can be used in combination at a particular jobsite to support an overlying structure and to stabilize surrounding soil. In this case, one or more support devices can be structurally connected to an overlying structure such as shown in the figures, and one or more additional support devices can be used as soil nails to stabilize the surrounding soil or rock formation. Even in tunnel construction, the support device of the present invention can be used to stabilize the soil or rock formation surrounding the tunnel. In a tunnel, a support device can be emplaced in any orientation to include stabilizing the ceiling/upper surface of the tunnel.

With the method and apparatus of the present invention, a subsurface support is provided which can be emplaced with a minimum of effort. The subsurface support provides an alternative to other anchoring means because the outer tube provides protection to the inner support member from corrosion or other undesirable environmental factors. Depending upon the geological conditions, the outer tube can be emplaced with a launching device which is adapted to account for varying geological formations. For example, ground formations with little rock allows emplacement of the outer tube with a minimum of force while placement of the outer tube into an actual rock formation would require a greater force provided by the launching mechanism. In any case, the particular launching device chosen may have the capability of emplacing the outer tube to the appropriate depth and through various rock and soil conditions.

While the method and the apparatus of the present invention have been provided in preferred embodiments, it shall be understood that various other changes and modifications may be made within the spirit and scope of the present invention.

What is claimed is:

1. A method of installing a subsurface support comprising the steps of:

providing a launching device including a chamber and a barrel disposed below the chamber;

loading an outer tubular member of said subsurface support in said launching device;

supporting the barrel of the launching device by a baffle disposed below the barrel so the barrel is spaced from the surface of the ground;

admitting pressurized gas to the chamber of the launching device;

allowing the outer tubular member to travel to and through the ground in response to increasing pressure in the chamber;

removing the launching device from over the emplaced outer tubular member;

inserting an inner support member through an open proximal end of said outer tubular member; and filling the outer tubular member with cementious material thereby securing the inner support member within the outer tubular member.

2. A method, as claimed in claim 1, further comprising the steps of:

prior to said loading step, forming openings in said outer tubular member; and after said filling step, further filling the outer tubular member with cementious material thereby forcing said cementious material through said openings to form external stabilizing features.

* * * * *